US005401600A

United States Patent [19]

Aizawa et al.

[11] Patent Number: 5,401,600

[45] Date of Patent: Mar. 28, 1995

[54] PHOTOSENSITIVE BODY FOR ELECTROPHOTOGRAPHY

[75] Inventors: Koichi Aizawa; Sumitaka Nogami; Takashi Obinata, all of Kawasaki, Japan

[73] Assignee: Fuji Electric Co., Ltd., Kanagawa, Japan

[21] Appl. No.: 950,544

[22] Filed: Sep. 24, 1992

[30] Foreign Application Priority Data

Sep. 27, 1991 [JP] Japan ..... 3-248127

[51] Int. Cl.[6] ..... G03G 5/14

[52] U.S. Cl. ..... 430/65

[58] Field of Search ..... 430/60, 61, 62, 63, 430/64, 65

[56] References Cited

U.S. PATENT DOCUMENTS

| | | | |
|---|---|---|---|
| 4,456,670 | 6/1984 | Nakayama et al. | 430/49 |
| 4,556,621 | 12/1985 | Hoffmann et al. | 430/49 |
| 4,647,521 | 3/1987 | Oguchi et al. | 430/66 |
| 4,897,329 | 1/1990 | Nakayama | 430/60 |

FOREIGN PATENT DOCUMENTS

| | | |
|---|---|---|
| 138404 | 4/1985 | European Pat. Off. . |
| 62-42498 | 5/1982 | Japan . |
| 57130039 | 8/1982 | Japan . |
| 60-057346 | 4/1985 | Japan . |
| 2-60178 | 9/1985 | Japan . |

OTHER PUBLICATIONS

"Hydrophobes Aerosil" Von Dr. Helmut Brünner et al., Chemiker-Zeitung Chemische Apparatur, 89 Jahrgang (1965) Nr. 13, pp. 437–440.

*Primary Examiner*—John Goodrow

*Attorney, Agent, or Firm*—Spencer, Frank & Schneider

[57] ABSTRACT

An intermediate layer having fine hydrophobic silica particles is positioned between a substrate and a photosensitive layer. The fine hydrophobic silica particles preferably have a primary particle-averaged particle size of not more than 50 nm and desirably the surface of the fine hydrophobic silica particles is alkyl-silylated or treated with silicone.

14 Claims, 1 Drawing Sheet

PHOTOSENSITIVE BODY FOR ELECTROPHOTOGRAPHY

BACKGROUND OF THE INVENTION

1. Field of the Invention

The present invention relates to a photosensitive body having a conductive substrate provided thereon with a photosensitive layer of an organic substance and more particularly to a photosensitive body which has an intermediate layer between a conductive substrate and a photosensitive layer and which can stably provide excellent images.

2. Description of the Prior Art

A photosensitive body for electrophotography used in the Carlson's electrophotography (hereinafter also referred to as simply "photosensitive body") has mainly included inorganic photoconductive materials such as selenium, selenium-tellurium alloy, selenium-arsenic alloy and zinc oxide. However, there have intensively been proceeded the development of photosensitive body having organic photoconductive material form the viewpoint of non-pollution properties and good film-forming ability and they have been put into practical use. Among these, there have been forwarded the development of so-called separated functional photosensitive body in which the photosensitive layer is separated into a charge-generating layer and a charge-transfer layer. This is because, it is highly probable that the separated functional photosensitive body can ensure a high sensitivity and a long lifetime through the combination of a charge-generating layer including a charge-generating substance having a high charge-generation efficiency and a charge-transfer layer including a charge-transfer substance having a high charge mobility.

Most of the separated functional photosensitive bodies which make use of organic photoconductive materials presently accepted have a structure which has a conductive substrate such as an aluminum substrate provided thereon with, in order, a charge-generating layer and a charge-transfer layer. As the thickness of the charge-generating layer increases, the charges generated within the charge-generating layer are not smoothly injected into the charge-transfer layer and the conductive substrate and this becomes a cause of various disadvantages such as formation of memories, a decrease of charging characteristics during repeated use and an increase in a residual potential. The thickness of the charge-generating layer must be as thin as possible and in general in the order of submicrons so as not to become such cause of the above disadvantages. To ensure sufficient absorption of incident light rays through such a thin film, the charge-generating substance must have a high absorptivity coefficient and a high charge-generating efficiency. Presently, pigment type substances have mainly been used as such charge-generating substances with satisfy the foregoing requirements.

Since a charge-generating layer is applied onto a conductive substrate in the form of a very thin film as has been described above, contaminants present on the surface of a substrate and non-uniformity of the shape thereof lead to the easy formation of uneven film. The formation of such an uneven film in turn leads to various image defects formed on photosensitive bodies such as missing of images, formation of black specs, uneven density of images and fogging. To solve these problems, many attempts have been directed to the development of, for instance, washing methods which can remove the contaminants present on the surface of substrates, materials for substrates which can inhibit the chipping phenomenon of the substrate during processing the surface thereof and improvement in finishing methods which allow the surface of the substrate uniform.

On the other hand, there has recently developed a laser printer which makes use of a laser as a light source for exposure and correspondingly attempts have been directed to the development of photosensitive bodies suitable for use in such a laser printer. In the laser printer, incident laser light rays for exposure (light for writing) reflected on the surface of a conductive substrate and the multiple reflection thereof within a photosensitive layer cause interference due to the coherency of the laser light and interference fringes due to this interference are appear on the photosensitive body as images, Japanese Patent Application Publication No. 60178/1990 discloses a method for solving this problem and which has roughening the surface of a substrate to inhibit interference of light rays. In this method, however, the surface of a substrate is intentionally made uneven and this results in the easy formation of an uneven charge-generating layer and accordingly the occurrence of image defects.

Moreover, Japanese Patent Application Publication No. 42498/1987 discloses a method for forming an intermediate layer between a conductive substrate and a photosensitive layer as methods for solving the problems of the formation of an uneven charge-generating layer due to contaminants present on the surface of the substrate and non-uniformity of the surface and as methods for forming an excellent uniform charge-generating layer on the surface of a conductive substrate whose surface is intentionally roughened to eliminate the formation of interference fringes. Examples of materials for such an intermediate layer include inorganic ones such as alumite and organic ones such as polyvinyl alcohol, polyamide, casein, gelatin and celluoise derivatives.

The foregoing intermediate layer must have a thickness sufficient for eliminating the influence of contaminants present on the surface of a substrate, non-uniformity of the shape thereof or the unevenness intentionally formed on the surface on the photosensitive layer subsequently applied to the surface thereof, while minimizing the deterioration of properties of the photosensitive layer due to the application of the intermediate layer. For this reason, the intermediate layer must have a low resistance sufficient for ensuring a current flow from the photosensitive layer to the conductive substrate. Moreover, it must inhibit the injection of charges from the substrate to the photosensitive layer after charging and, in other words, it must have blocking properties. However, the intermediate layers conventionally known do not always satisfy the foregoing requirements.

SUMMARY OF THE INVENTION

The present invention has been developed to solve the foregoing problems associated with the conventional techniques and accordingly, the object of the present invention is to provide a photosensitive body which has excellent electrical properties, does not exhibit any property change and image-quality change due to variation in environmental conditions, even after the use thereof over a long time period and accordingly, can stably provide high-quality images.

According to the present invention, the foregoing problems can be solved by providing a photosensitive body having a conductive substrate, a photosensitive layer and an intermediate layer which has fine hydrophobic silica particles and is positioned between the substrate and the photosensitive layer. The fine hydrophobic silica particles desirably have an average particle size of 50 nm of smaller which is an average of primary particles free of aggregation. In addition, the fine hydrophobic silica particles are preferably those whose surface is alkyl-silylated or treated with silicone.

The above and other objects, effects, features and advantages of the present invention will become more apparent from the following description of embodiments thereof taken in conjunction with the accompanying drawings.

DESCRIPTION OF PREFERRED EMBODIMENTS

Figure 1:
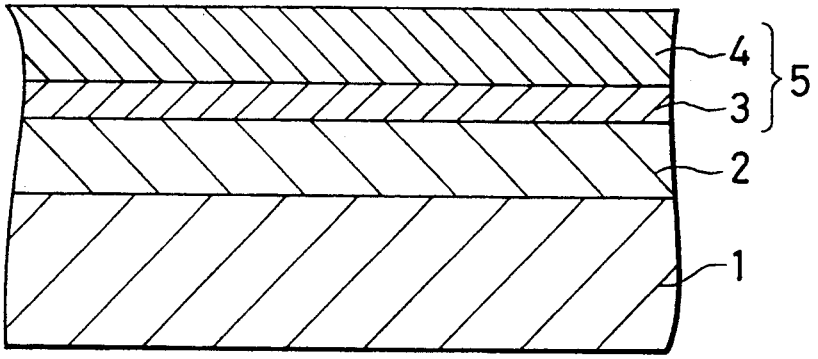
FIG. 1 is a schematic cross sectional view showing an embodiment of the photosensitive body for electrophotography according to the present invention.

In FIG. 1, reference numeral 1 represents a conductive substrate, 2 represents an intermediate layer, 3 represents a charge-generating layer, 4 is a charge-transfer layer and 5 is a photosensitive layer which is constituted by the charge-generating layer 3 and the charge-transfer layer 4.

According to the present invention, the intermediate layer 2 has fine hydrophobic silica particles. The intermediate layer 2 may be applied to a thickness sufficient to eliminate the influence of contaminants present on the surface of the conductive substrate, non-uniformity of the shape thereof or unevenness intentionally imparted to the surface without impairing characteristic properties of the photosensitive layer and while maintaining a small variation in electrical properties such as resistance and blocking characteristics due to changes in environmental conditions and the intermediate layer thus serves to ensure excellent quality. Hydrophobic silica particles having a primary particle-averaged particle size of not more than 50 nm are preferably used as the fine hydrophobic silica particles. This is because, the use thereof allows easy formation of a film having uniform quality and a uniform thickness as well as excellent properties suitable for use as an intermediate layer. Moreover, the surface of the fine hydrophobic silica particles are preferably alkyl-silylated or treated with silicone since this results in the formation of the intermediate layer 2 having good quality and low variation in characteristic properties due to changes in environmental conditions.

The fine hydrophobic silica particles are prepared by combusting silicon tetrachloride in an oxygen/hydrogen atmosphere and then reacting the resulting fine silica powder with chlorosilane as disclosed in Chemische Zeitschrift, 1979, 89, p. 651.

The intermediate layer 2 is obtained by dispersing the fine hydrophobic silica particles thus produced in a binder to give a coating liquid and then applying it to the surface of a substrate. Examples of binders include butyral resins and derivative thereof such as polyvinyl butyral, polyvinyl acetal, polyvinyl formal, casein, gelatin, copolymerized nylons such as nylon 6/6 and nylon 6/66/610/12, polyamides such as alkoxymethylated nylon, cellulose derivatives such as nitrocellulose, carboxymethyl cellulose and hydroxyethyl cellulose, ethylene/acrylic acid copolymer, ethylene/maleic acid copolymer, styrene/maleic acid copolymer, polyamides, polyesterimide, polyurethane and epoxy resins. These binders may be used alone or in any combination and the intermediate layer 2 may have a three-dimensional structure through hardening. Among these binders, particularly preferred are, for instance, copolymerized polyamides, polyesteramides, alkoxymethylated polyamides and polyvinyl acetal (formal) which are soluble in polar solvents. The amount of the fine hydrophobic silica particles to be added to the binder is determined depending on various factors such as degree of contamination of the surface of the substrate, the kinds and size of surface defects and characteristic properties required for the photosensitive layer, but preferably ranges from 0.05 to 10 parts by weight and more preferably 0.1 to 8 parts by weight per one part by weight of the binder. The intermediate layer having the fine hydrophobic silica particles in an amount falling within the range defined above serves to prevent any formation of defects on the photosensitive layer and to substantially improve electrical properties of the photosensitive layer.

The thickness of the intermediate layer 2 is likewise determined while taking into consideration factors such as surface conditions of conductive substrates used and characteristic properties required for the photosensitive layers 5, but in general ranges from 0.1 to 10 $\mu$m and preferably the layer is formed in a thickness as thin as possible so far as the function thereof is not impaired.

Moreover, the intermediate layer 2 used in the present invention may have other additives, for instance, cyanine dyes, thiazine dyes, metallocenes such as nickelocene, ferrocene and manganocene, acetylacetonate complexes such as cobalt acetylacetonate, nickel acetylacetonate and manganese acetylacetonate, and/or carboxylic acid salts such as cobalt naphthenate and manganese naphthenate. The addition of these additives permits the reduction of the residual potential. These additives may be used alone or as a mixture thereof.

According to the present invention, the intermediate layer 2 is first formed on the substrate 1 and then the photosensitive layer 5 is applied thereon to give a photosensitive body of the invention as has been discussed above. The optimum effect of the present invention can be obtained when the present invention is applied to so-called separated functional photosensitive body in which the photosensitive layer 5 is divided into the charge-generating layer 3 and the charge-transfer layer 4 and in particular those having a structure having the substrate 1 provided thereon with, in order, the charge-generating layer 3 and the charge-transfer layer 4 serving as a photosensitive layer.

In the foregoing separated functional photosensitive body, the charge-generating layer 3 is formed by dispersing or dissolving an inorganic or organic charge-generating substance alone or in combination with a binder in an organic solvent, then applying the resulting dispersion or a solution to the surface of a conductive substrate and drying. Alternatively, a thermally stable charge-generating substance may be formed into a film through sublimation in a vacuum. Examples of charge-generating substances are azo type pigments, anthraquinone type pigments, polynucleic quinone type pigments, indigo type pigments, dephenylmethane type pigments, azine type pigments, cyanine type pigments, perylene type pigments, squalilium pigments and phthalocyanine type pigments. Examples of binders include polyamide resins, silicone resins, polyester resins, polycarbonate resins, phenoxy resins, polystyrene resins, polyvinyl (butyral, formal, acetal) resins, methacrylic resins and vinyl chloride type resins, which may be used alone or in any combination. These binders are used in an amount ranging from 5 to 200 parts by weight and preferably 10 to 100 parts by weight per 100 parts by weight of the charge-generating substance. The thickness of the charge-generating layer 3 preferably ranges from 0.05 to 2.0 μm. The charge-transfer layer 4 is positioned in close contact with charge-generating layer 3 and is formed by applying a solution of a polymeric compound such as poly(N-vinylcarbazole) poly (vinylanthracene) or polysilane and then drying; or by dissolving, in an organic solvent, a low molecular weight compound such as a hydrazone, pyrazoline, enamine, styryl, arylmethane, arylamine, butadiene or azine compound in combination with a proper binder having a film-forming ability, applying the resulting solution and then drying. Examples of binders used in combination with these low molecular weight compounds include polycarbonate resins, polyester resins, polystyrene resins, methacrylic resins, silicone resins and polyether resins. These binders are used in an amount ranging from 50 to 200 parts by weight per 100 parts by weight of the low molecular weight compound. The thickness of the charge-transfer layer 4 desirably ranges from 10 to 30 μm.

The present invention will hereinafter be explained with reference to the following Examples, but the present invention is by no means limited to the following specific Examples. In the following description, the term "part" means "part by weight" unless otherwise specified.

Example 1

The parts of an alcohol-soluble copolymerized polyamide (Amila CM-8000, a nylon 6/66/610/12 copolymer; available from Toray Industries, Inc.) were dissolved in 600 parts by weight of methanol, followed by addition of 25 parts of fine hydrophobic silica particles whose surface had been treated with silicone having averaged particle size (of primary particles) of 16 nm (Aerosil R972, ultrafine particles of anhydrous silica, available from Nippon Aerosil Co., Ltd. ) , dispersing by a paint shaker and application of ultrasonic waves to the resulting dispersion to give a coating liquid for forming intermediate layers having a solid content of 4.8% by weight.

This coating liquid for intermediate layer was applied to a substrate of an aluminum cylinder having an outer diameter of 60 mm, a length of 247 mm and a thickness of 1 mm, outer surface of which had been surface-toughened so that the 10 point-averaged surface roughness Rz was 1.4 μm by immersing the substrate in the liquid so that the substrate was coated with a film of the liquid having a thickness (determined after drying) of 3 μm to form an intermediate layer.

An X type metal free phthalocyanine (1 part; Fastogen Blue 8120B, available from Dainippon Ink and Chemicals, Inc.) was dispersed in 100 parts of dichloromethane in a paint shaker to give a coating liquid for charge-generating layer. The liquid was applied to the intermediate layer by dipping the substrate therein to a thickness (determined after drying) of 0.4 μm. Further, the substrate was dipped in a coating liquid for charge-transfer layer which comprised 10 parts of p-diethylaminobenzaldehyde-(diphenylhydrazone), 10 parts of a polycarbonate resin (Yupiron PCZ-300, available from Mitsubishi Gas Chemical Col, Inc.) and 72 parts of 1,2-dichloroethane to form a charge-transfer layer having a thickness (determined after drying) of 20 μm and to thus complete a photosensitive body.

Example 2

There was provided a substrate comprising an extrusion drawing finished aluminum cylinder having an outer diameter of 60 mm, a length of 344 mm and a thickness of 1 mm. Separately, a coating liquid for intermediate layer was prepared by dispersing, in 800 parts of methanol in a paint shaker, 10 parts of a copolymerized polyamide (Alamin CM-4001, available from Toray Industries, Inc.) and 30 parts of fine hydrophobic silica particles whose surface had been alkyl silylated and having a primary particle-averaged particle size of 7 nm (Aerosil R812, ultrafine particulate anhydrous silica, available from Nippon Aerosil Co., Ltd. ) and then applying ultrasonic waves to the dispersion. The resulting dispersion was applied onto the outer surface of the aluminum cylinder by immersing the cylinder in the dispersion so that the cylinder was coated with a film of the dispersion having a thickness of 3 μm (determined after drying) to form an intermediate layer.

Then a coating liquid for charge-generating layer was prepared by dispersing, in a mixture of 55 parts of methyl ethyl ketone and 30 parts of cyclohexanone in a paint shaker, 7 parts of a charge-generating substance represented by the following structural formula (1) and a polyvinyl acetal resin (Eslex KS-1 available from Sekisui Chemcial Co., Ltd. ) and then further dispersing through application of ultrasonic waves. The resulting coating liquid was applied onto the intermediate layer to a thickness of 0.6 μm (determined after drying) to form a charge-generating layer.

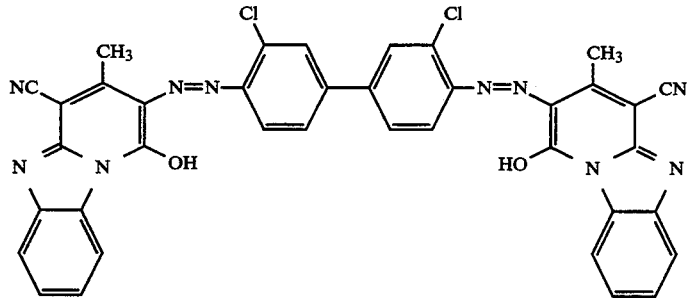

(1)

Furthermore, a coating liquid for charge-transfer layer was prepared by dissolving, in 60 parts of dichloromethane, 10 parts of a polycarbonate resin (Yupiron PCZ-300, available from Mitsubishi Gas Chemical Co., Inc.) and 10 parts of charge-transfer substance represented by the following structural formula (2). The resulting solution was dis-coated on the change-generating layer to a thickness (determined after drying) of 25 μm to form a charge-transfer layer and to thus complete a photosensitive body.

(2)

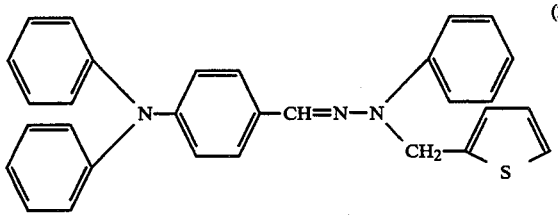

Comparative Example 1

The same procedures used in Example 1 were repeated except that untreated silica fine particle having a primary particle-averaged particle size of 12 nm (Aerosil #200, available from Nippon Aerosil Co., Ltd.) was substituted for the fine hydrophobic silica particles whose surface had been treated with silicone having averaged particle size (of primary particles) of 16 nm (Aerosil R972, ultrafine particles of anhydrous silica, available from Nippon Aerosil Co., Ltd.) used in Example 1 to give a comparative photosensitive body.

Comparative Example 2

A coating liquid for intermediate layer was prepared according to the same procedures used in Example 1 except that fine hydrophobic silica particles was not used and the resulting coating liquid was applied onto a substrate to form an intermediate layer having a thickness of 2 μm (determined after drying). A charge-generating layer and a charge-transfer layer were, in order, formed on the intermediate layer in the same manner used in Example 1 to give another comparative photosensitive body.

Comparative Example 3

The same procedures used in Example 2 were repeated except that no intermediate layer was formed to give a further comparative photosensitive body.

In the photosensitive bodies obtained in Example 1 and Comparative Examples 1 and 2, an X-type metal free phthalocyanine is used as a charge-generating substance and, therefore, these photosensitive bodies are sensitive to lights of long wave lengths. These photosensitive bodies were fitted into a photosensitive body process tester, electrified by application of a voltage of −600V while being rotated at a circumferential speed of 78.5 mm/sec, followed by partial irradiation with a light beam of 780 nm and determination of the potential Vi observed on the portion irradiated at 2 μJ/cm$^2$ for 0.2 sec (so-called bright potential) and that Vd observed on the portion which was not irradiated (so-called dark potential). Then a bias potential was set to −250V to form an image and the quality of the images was evaluated. These measurements and evaluation were performed under low temperature/low humidity conditions (temperature: 10° C.; relative humidity: 50%); ordinary temperature/ordinary humidity conditions (temperature: 25° C.; relative humidity: 50%); and high temperature/high humidity conditions (temperature: 35° C.; relative humidity: 85%) . The results obtained are listed in Tables 1 to 3 as initial properties.

TABLE 1

| | Initial Properties (low temperature and low humidity conditions) | | |
|---|---|---|---|
| Photosensitive Body | Vd (V) | Vi (V) | Image |
| Example 1 | −600 | −110 | good |
| Comparative Example 1 | −600 | −120 | images are disturbed |
| Comparative Example 2 | −600 | −150 | density is lowered |

TABLE 2

| | Initial Properties (ordinary temperature and ordinary humidity conditions) | | |
|---|---|---|---|
| Photosensitive Body | Vd (V) | Vi (V) | Image |
| Example 1 | −600 | −110 | good |
| Comparative Example 1 | −600 | −100 | images are disturbed |
| Comparative Example 2 | −600 | −110 | good |

TABLE 3

| | Initial Properties (high temperature and high humidity conditions) | | |
|---|---|---|---|
| Photosensitive Body | Vd (V) | Vi (V) | Image |
| Example 1 | −590 | −90 | good |
| Comparative Example 1 | −580 | −80 | images are disturbed |
| Comparative Example 2 | −530 | −100 | fogging |

Then the imaging operation was repeated over 20,000 times under the foregoing conditions Vd and Vi were determined and the quality of the images was evaluated in the same manner used for the determination of the initial properties. The results thus obtained are summarized in the following Tables 4 to 6.

TABLE 4

| | Properties observed after image-formation over 20,000 times (low temperature and low humidity conditions | | |
|---|---|---|---|
| Photosensitive Body | Vd (V) | Vi (V) | Image |
| Example 1 | −580 | −120 | good |
| Comparative Example 1 | −570 | −150 | images are greatly disturbed |
| Comparative Example 2 | −600 | −220 | insufficient density |

TABLE 5

| | Properties observed after image-formation over 20,000 times (ordinary temperature and ordinary humidity conditions) | | |
|---|---|---|---|
| Photosensitive Body | Vd (V) | Vi (V) | Image |
| Example 1 | −590 | −110 | good |
| Comparative Example 1 | −590 | −120 | black specs; missing of images |
| Comparative Example 2 | −590 | −120 | fogging |

TABLE 6

| | Properties observed after image-formation over 20,000 times (high temperature and high humidity conditions) | | |
|---|---|---|---|
| Photosensitive Body | Vd (V) | Vi (V) | Image |
| Example 1 | −580 | −90 | good |
| Comparative Example 1 | −560 | −80 | images are greatly disturbed |

TABLE 6-continued

| Photosensitive Body | Properties observed after image-formation over 20,000 times (high temperature and high humidity conditions) Vd (V) | Vi (V) | Image |
|---|---|---|---|
| Comparative Example 2 | −420 | −110 | insufficient density |

The data shown in Tables 1 to 6 clearly indicate that the photosensitive body of the present invention exhibits excellent effects. More specifically, the photosensitive body of Example 1 in which the intermediate layer has fine hydrophobic silica particles shows excellent electrical properties and quality of images under the environmental conditions examined (both initial properties and those observed after image-formation of 20,000 times) as compared with those observed on the photosensitive body of Comparative Example 1 in which the intermediate layer has untreated fine silica particles and on the photosensitive body of Comparative Example 2 in which the intermediate layer has neither the hydrophobic nor untreated fine silica particles.

Then the photosensitive bodies in Example 2 and Comparative Example 3 were fitted to a commercially available copying machine (FP-3270 available from Matsushita Electric Industrial Co., Ltd. ) and initial values: a dark potential Vb on the developed portion, a potential Vh on the portion of medium tone and potential Vw on the non-image portion were determined under ordinary temperature/ordinary humidity conditions. Further the resulting images were evaluated. The results obtained are listed in the following Table 7.

TABLE 7

| Photosensitive Body | Initial Properties (ordinary temperature and ordinary humidity conditions) Vd (V) | Vi (V) | Vw (V) | Image |
|---|---|---|---|---|
| Comparative Example 2 | −800 | −350 | −100 | good |
| Comparative Example 3 | −800 | −350 | −100 | black specs; missing of images |

Further the imaging operation was repeated over 20,000 times under ordinary temperature/ordinary humidity conditions using the foregoing copying machine and then the foregoing potentials were determined and the resulting images were evaluated. The results thus obtained are summarized in the following Table 8.

TABLE 8

| Photosensitive Body | Properties observed after image-formation over 20,000 times (ordinary temperature and ordinary humidity conditions) Electrical Properties and Evaluation of Images Formed Vd (V) | Vi (V) | Vw (V) | Image |
|---|---|---|---|---|
| Comparative Example 2 | −780 | −360 | −120 | good |
| Comparative Example 3 | −810 | −400 | −200 | severe fogging; increase in black specs and missing of images |

The data shown in Tables 7 and 8 clearly indicate that the photosensitive body according to the present invention is very excellent and that the material of the present invention is likewise effective for use in copying machines.

In the photosensitive body according to the present invention, an intermediate layer having fine hydrophobic silica particles is positioned between the substrate and the the photosensitive layer. The photosensitive body provided with such an intermediate layer shows excellent electrical properties and can provide excellent images, does now show changes in electrical properties and in quality of images due to changes in environmental conditions even after operating over a long time period and accordingly can stably provide good images.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photosensitive body for electrophotography, comprising:

a conductive substrate;

an intermediate layer formed on said conductive substrate, said intermediate layer being non-photosensitive and consisting essentially of fine particles of hydrophobic silica and a binder in which said fine particles of hydrophobic silica are dispersed; and a photosensitive layer formed on said intermediate layer.

2. A photosensitive body as claimed in claim 1, wherein said fine particles have a primary particle-averaged particle size of not more than 50 nm.

3. A photosensitive body as claimed in claim 1, wherein the surface of said fine particles is alkyl-silylated.

4. A photosensitive body as claimed in claim 1, wherein the surface of said fine particles is treated with silicone.

5. A photosensitive body as claimed in claim 2, wherein the surface of said fine particles is alkyl-silylated.

6. A photosensitive body as claimed in claim 2, wherein the surface of said fine particles is treated with silicone.

7. A photosensitive body for electrophotography, comprising:

a conductive substrate;

an intermediate layer formed on said conductive substrate, said intermediate layer being non-photosensitive and consisting essentially of fine particles of hydrophobic silica and a binder in which said fine particles of hydrophobic silica are dispersed, said hydrophobic silica being composed of silica rendered hydrophobic by surface treatment thereof; and a photosensitive layer formed on said intermediate layer.

8. The photosensitive body as claimed in claim 7, wherein said fine particles have a primary particle-averaged particle size of not more than 50 nm.

9. The photosensitive body as claimed in claim 7, wherein said fine particles of hydrophobic silica have surfaces which are one of alkyl-silylated or silicone treated to render them hydrophobic.

10. The photosensitive body as claimed in claim 7, wherein said binder is at least one material selected from the group consisting of butyral resins and derivatives thereof, polyvinyl acetals, polyvinyl formals, casein, gelatin, polyamides, cellulose derivatives, ethylene/a-crylic acid copolymers, ethylene/maleic acid copolymers, styrene/maleic acid copolymers, polyesterimides, polyurethanes, and epoxy resins.

11. The photosensitive body as claimed in claim 10, wherein said binder is at least one material selected from the group consisting of copolymerized polyamides, polyesteramides, alkoxymethylated polyamides, polyvinyl acetals, and polyvinyl formals.

12. The photosensitive body as claimed in claim 7, wherein from 0.05 to 10 parts by weight of said fine particles of hydrophobic silica are dispersed in one part by weight of said binder.

13. The photosensitive body as claimed in claim 12, wherein from 0.1 to 8 parts by weight of said fine particles are dispersed in one part by weight of said binder.

14. The photosensitive body as claimed in claim 7, wherein the intermediate layer has a thickness ranging from 0.1 to 10 μm.

* * * * *